US009929002B2

(12) United States Patent
Giles et al.

(10) Patent No.: US 9,929,002 B2
(45) Date of Patent: Mar. 27, 2018

(54) HIGH PRESSURE MASS RESOLVING ION GUIDE WITH AXIAL FIELD

(71) Applicant: Micromass UK Limited, Wilmslow (GB)

(72) Inventors: Kevin Giles, Stockport (GB); Martin Raymond Green, Bowdon (GB); Darren Hewitt, Leigh (GB); Daniel James Kenny, Knutsford (GB); David J. Langridge, Macclesfield (GB); Steven Derek Pringle, Darwen (GB); Jason Lee Wildgoose, Stockport (GB)

(73) Assignee: MIROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/105,092

(22) PCT Filed: Dec. 17, 2014

(86) PCT No.: PCT/GB2014/053737
§ 371 (c)(1),
(2) Date: Jun. 16, 2016

(87) PCT Pub. No.: WO2015/092399
PCT Pub. Date: Jun. 25, 2015

(65) Prior Publication Data

US 2017/0032954 A1 Feb. 2, 2017

(30) Foreign Application Priority Data

Dec. 19, 2013 (EP) ..... 13198382
Dec. 19, 2013 (GB) ..... 1322515.6

(51) Int. Cl.
*H01J 49/42* (2006.01)

(52) U.S. Cl.
CPC ..... *H01J 49/4215* (2013.01)

(58) Field of Classification Search
CPC ..... H01J 49/4215
See application file for complete search history.

(56) References Cited

U.S. PATENT DOCUMENTS

| | | | | |
|---|---|---|---|---|
| 5,847,386 | A | 12/1998 | Thomson et al. | |
| 6,093,929 | A | 7/2000 | Javahery et al. | |
| 6,909,089 | B2 | 6/2005 | Londry et al. | |
| 6,987,264 | B1 | 1/2006 | Whitehouse et al. | |
| 7,164,125 | B2 | 1/2007 | Weiss et al. | |
| 7,189,967 | B1 | 3/2007 | Whitehouse et al. | |
| 7,230,238 | B2 * | 6/2007 | Miller | G01N 27/624 250/281 |
| 7,459,679 | B2 | 12/2008 | Loboda | |

(Continued)

FOREIGN PATENT DOCUMENTS

| | | |
|---|---|---|
| EP | 1643536 | 4/2006 |
| EP | 1763064 | 3/2007 |

(Continued)

*Primary Examiner* — Jason McCormack
*Assistant Examiner* — Sean Luck

(57) ABSTRACT

A mass spectrometer is disclosed comprising a first mass filter comprising a plurality of electrodes and a first device arranged and adapted to generate an axial force which drives at least some ions axially through or along the first mass filter and a quadrupole mass filter or mass analyzer arranged downstream of the mass filter.

19 Claims, 6 Drawing Sheets

(56) References Cited

U.S. PATENT DOCUMENTS

| | | | |
|---|---|---|---|
| 7,709,785 | B2 | 5/2010 | Jolliffe et al. |
| 8,415,617 | B2 | 4/2013 | Schwartz |
| 8,598,517 | B2 | 12/2013 | McLuckey et al. |
| 8,941,058 | B2 | 1/2015 | Franzen |
| 9,312,118 | B2 | 4/2016 | Hoyes |

FOREIGN PATENT DOCUMENTS

| | | |
|---|---|---|
| EP | 2665085 | 11/2013 |
| GB | 2396958 | 7/2004 |
| GB | 2443952 | 5/2008 |
| GB | 2467466 | 8/2010 |
| GB | 2470664 | 12/2010 |
| WO | 2007/125354 | 11/2007 |

* cited by examiner

HIGH PRESSURE MASS RESOLVING ION GUIDE WITH AXIAL FIELD

CROSS REFERENCE TO RELATED APPLICATIONS

This application is the National Stage of International Application No. PCT/GB2014/053737, filed 17 Dec. 2014 which claims priority from and the benefit of United Kingdom patent application No. 1322515.6 filed on 19 Dec. 2013 and European patent application No. 13198382.7 filed on 19 Dec. 2013. The entire contents of these applications are incorporated herein by reference.

BACKGROUND TO THE PRESENT INVENTION

The present invention relates to a mass spectrometer and a method of mass spectrometry. A preferred embodiment of the present invention relates to a mass filter arranged upstream of an analytical quadrupole rod set mass filter or mass analyser.

Quadrupole rod set mass filters are well known and comprise four rod electrodes. A RF voltage and a resolving DC voltage are simultaneously applied to the rod electrodes so that the mass filter operates in a mass or mass to charge ratio resolving mode of operation. As will be well understood by those skilled in the art, when a quadrupole rod set mass filter is operated in a mass resolving mode of operation ions having mass to charge ratios within a desired mass to charge ratio range will be onwardly transmitted by the mass filter but undesired ions having mass to charge ratios outside of the mass to charge ratio range will be substantially attenuated. Ions which are not desired to be onwardly transmitted by the mass filter are attenuated either by causing the ions to assume unstable trajectories such that the ions impact upon the rod electrodes or else by radially ejecting the ions from the mass filter.

One problem with conventional quadrupole rod set mass filters operated in a mass resolving mode of operation is that they suffer significantly reduced performance at increased pressures. This is in part due to the axial cooling of the ions which results in prolonged transit times and a corresponding increased exposure to the resolving RF and DC electric fields. In particular, if ions which are desired to be onwardly transmitted by the mass filter are present for too long within the mass filter and experience too many cycles of the applied RF voltage then the ions can be inadvertently radially ejected. As a result, the ion transmission efficiency of the mass filter for ions which are desired to be onwardly transmitted by the mass filter will be significantly reduced.

Another significant problem with conventional arrangements is that analytical quadrupoles can be exposed to relatively high ion currents with the result that a relatively large number of undesired ions possess unstable trajectories through the analytical quadrupole with the result that a relatively large number of ions are not onwardly transmitted by the analytical quadrupole. A relatively high percentage of the ions which are not onwardly transmitted impinge upon the rods of the analytical quadrupole. As a result the rods of the analytical quadrupole can quickly become contaminated and the analytical quadrupole will suffer form a loss of resolution due to surface charging effects.

As will be understood by those skilled in the art, cleaning the rods of an analytical quadrupole rod set is a non-trivial task which requires a service engineer and for the mass spectrometer to be taken offline.

U.S. Pat. No. 6,987,264 (Whitehouse) discloses an arrangement wherein at least two multipole ion guides are arranged adjacent to each other. U.S. Pat. No. 6,987,264 (Whitehouse) is not concerned with the problem of the rods of an analytical quadrupole becoming contaminated.

It is desired to provide an improved spectrometer and method of mass spectrometry.

SUMMARY OF THE PRESENT INVENTION

According to an aspect of the present invention there is provided a mass spectrometer comprising:

a first mass filter comprising a plurality of electrodes and a first device arranged and adapted to generate an axial force which drives at least some ions axially through or along the first mass filter; and a quadrupole mass filter or mass analyser arranged downstream of the mass filter.

The present invention solves the problem of the rods of an analytical quadrupole becoming contaminated by providing a (first) mass filter upstream of the analytical quadrupole mass filter or mass analyser. The (first) mass filter is preferably maintained at a relatively high pressure and an axial force is preferably maintained along the length of the first mass filter in order to drive ions axially along the length of the mass filter.

The present invention is particularly advantageous in that the upstream mass filter is arranged so as to significantly reduce contamination of the rods of the analytical quadrupole rod set.

The quadrupole mass filter or mass analyser preferably comprises an analytical mass filter or mass analyser.

The first mass filter is preferably arranged and adapted to be operated in a substantially synchronised manner with the quadrupole mass filter or mass analyser.

The first mass filter is preferably arranged and adapted to be operated so as to substantially restrict or reduce the ion current transmitted to the quadrupole mass filter or mass analyser.

The first mass filter and the quadrupole mass filter or mass analyser are preferably arranged and adapted to be operated in a mode of operation wherein the first mass filter is arranged to mass filter ions with a first mass resolution $R_1$ and wherein at substantially the same time $T_1$ the quadrupole mass filter or mass analyser is arranged to mass filter ions with a second mass resolution $R_2$, wherein $R_2>R_1$.

U.S. Pat. No. 6,987,264 (Whitehouse) does not teach or suggest operating a mass filter upstream of an analytical quadrupole with a lower resolution than that of the analytical quadrupole.

The first mass resolution $R_1=(m/z)/W_{1/2}$ wherein m/z is the mass to charge ratio of an ion peak and $W_{1/2}$ is the ion peak width at half height and wherein the second mass resolution $R_2=(m/z)/W_{1/2}$ wherein m/z is the mass to charge ratio of an ion peak and $W_{1/2}$ is the ion peak width at half height.

The first mass filter and the quadrupole mass filter or mass analyser are preferably arranged and adapted to be operated in a mode of operation wherein the first mass filter is arranged to transmit ions having a first mass to charge ratio $M_1$ and wherein at substantially the same time $T_1$ the quadrupole mass filter or mass analyser is arranged to transmit ions having a second mass to charge ratio $M_2$, wherein $M_1=M_2$.

U.S. Pat. No. 6,987,264 (Whitehouse) does not teach or suggest operating a mass filter upstream of an analytical quadrupole so that the centre of the upstream mass filter transmission window coincides with the centre of the transmission window of the analytical quadrupole.

The present invention is particularly advantageous in that the upstream mass filter is arranged so as to significantly reduce contamination of the analytical quadrupole rod set.

At the time $T_1$ the first mass filter is preferably arranged to attenuate ions having a mass to charge ratio less than and/or greater than $M_1$.

At the time $T_1$ the quadrupole mass filter or mass analyser is preferably arranged and adapted to attenuate ions having a mass to charge ratio less than and/or greater than $M_2$.

The first mass filter and the quadrupole mass filter or mass analyser are preferably arranged and adapted to be operated in a mode of operation wherein the first mass filter is arranged to transmit ions having a first mass to charge ratio or first mass to charge ratio range $M_1$ and wherein at substantially the same time $T_1$ the quadrupole mass filter or mass analyser is arranged to transmit ions having a second mass to charge ratio or second mass to charge ratio range $M_2$, wherein $M_1-M_2 \leq x$ Da and wherein x is selected from the group consisting of: (i) 10; (ii) 5; (iii) 1; (iv) 0.5; (v) 0.1; (vi) 0.05; (vii) 0.01; (viii) 0.005; and (ix) 0.001.

U.S. Pat. No. 6,987,264 (Whitehouse) does not teach or suggest operating a mass filter upstream of an analytical quadrupole so that the centre of the upstream mass filter transmission window substantially coincides with the centre of the transmission window of the analytical quadrupole.

The present invention is particularly advantageous in that the upstream mass filter is arranged so as to significantly reduce contamination of the analytical quadrupole rod set.

At the time $T_1$ the first mass filter is preferably arranged to attenuate ions having a mass to charge ratio less than and/or greater than $M_1$.

At the time $T_1$ the quadrupole mass filter or mass analyser is preferably arranged and adapted to attenuate ions having a mass to charge ratio less than and/or greater than $M_2$.

The first mass filter and/or the quadrupole mass filter or mass analyser are preferably arranged and adapted to be maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

The first mass filter and/or the quadrupole mass filter or mass analyser preferably have an axial length selected from the group consisting of: (i) <10 mm; (ii) 10-20 mm; (iii) 20-30 mm; (iv) 30-40 mm; (v) 40-50 mm; (vi) 50-60 mm; (vii) 60-70 mm; (viii) 70-80 mm; (ix) 80-90 mm; (x) 90-100 mm; (xi) 100-110 mm; (xii) 110-120 mm; (xiii) 120-130 mm; (xiv) 130-140 mm; (xv) 140-150 mm; (xvi) 150-160 mm; (xvii) 160-170 mm; (xviii) 170-180 mm; (xix) 180-190 mm; (xx) 190-200 mm; and (xxi) >200 mm.

The first mass filter and/or the quadrupole mass filter or mass analyser are preferably arranged to be maintained at a pressure P and has an axial length L, wherein the product P×L is selected from the group consisting of: (i) <0.001 mbar-mm; (ii) 0.001-0.01 mbar-mm; (iii) 0.01-0.1 mbar-mm; (iv) 0.1-1 mbar-mm; (v) 1-10 mbar-mm; (vi) 10-100 mbar-mm; (vii) 100-1000 mbar-mm; (viii) 1000-10,000 mbar-mm; (ix) 10,000-100,000 mbar-mm; and (x) >100,000 mbar-mm.

According to an embodiment the mass spectrometer preferably further comprises a second device arranged and adapted to apply one or more DC resolving voltages to at least some of the electrodes in order to cause undesired ions to assume unstable trajectories through the first mass filter and/or to cause undesired ions to be radially ejected from the first mass filter.

The second device is preferably arranged and adapted to cause undesired ions to be substantially attenuated.

The mass spectrometer preferably further comprises a third device arranged and adapted to apply RF voltages to at least some of the electrodes in order to cause undesired ions to assume unstable trajectories through the first mass filter and/or to cause undesired ions to be radially ejected from the first mass filter.

The third device is preferably arranged and adapted to cause undesired ions to be substantially attenuated.

The plurality of electrodes preferably comprise a quadrupole rod set.

The quadrupole rod set preferably comprises an axially segmented quadrupole rod set. The axially segmented quadrupole rod set preferably comprise at least 4, 5, 6, 7, 8, 9, 10, 11, 12, 13, 14, 15, 16, 17, 18, 19 or 20 segments.

The plurality of electrodes preferably comprises a plurality of ring electrodes or other electrodes having at least one aperture through which ions are transmitted in use. According to an embodiment at least 4, 5, 6, 7, 8, 9, 10, 11, 12, 13, 14, 15, 16, 17, 18, 19 or 20 ring electrodes or other electrodes are preferably provided.

The plurality of ring electrodes are preferably radially segmented.

The first device is preferably arranged and adapted to maintain a DC axial electric field or a DC potential gradient across at least a section of the axial length of the first mass filter in order to urge at least some ions along at least a portion of the axial length of the first mass filter so as to generate the axial force.

The first device is preferably arranged and adapted to apply one or more transient DC voltages to the plurality of electrodes in order to urge at least some ions along at least a portion of the axial length of the first mass filter so as to generate the axial force.

The first mass filter preferably further comprises one or more vane electrodes.

The first device is preferably arranged and adapted to apply either: (i) a DC voltage to the one or more vane electrodes in order to urge at least some ions along at least a portion of the axial length of the first mass filter; and/or (ii) one or more transient DC voltages to the one or more vane electrodes in order to urge at least some ions along at least a portion of the axial length of the first mass filter; and/or (iii) a multi-phase RF voltage to the one or more vane electrodes in order to urge at least some ions along at least a portion of the axial length of the first mass filter.

The first device is preferably arranged and adapted to apply a multi-phase RF voltage to the plurality of electrodes in order to urge at least some ions along at least a portion of the axial length of the first mass filter so as to generate the axial force.

The first device preferably comprises a gas flow device which is arranged and adapted to urge at least some ions along at least a portion of the axial length of the first mass filter so as to generate the axial force.

The first mass filter is preferably switchable to operate in a mode of operation wherein ions are onwardly transmitted substantially independently of their mass to charge ratio.

The first mass filter is preferably arranged to be switched to operate in a RF only mode of operation.

When the first mass filter is operated in the RF only mode of operation the first mass filter preferably acts as a broadband ion transmission ion guide.

The mass spectrometer preferably further comprises an ion mobility spectrometer or separator arranged upstream of the first mass filter, wherein the first mass filter is arranged and adapted to mass filter ions which emerge from or elute from the ion mobility spectrometer or separator.

The first mass filter and the quadrupole mass filter or mass analyser are preferably located in the same or different vacuum chambers.

According to another aspect of the present invention there is provided a method of mass spectrometry comprising:

providing a first mass filter comprising a plurality of electrodes and a quadrupole mass filter or mass analyser arranged downstream of the mass filter; and generating an axial force which drives at least some ions axially through or along the first mass filter.

According to another aspect of the present invention there is provided a mass spectrometer comprising:

a first mass filter comprising a plurality of electrodes and a first device arranged and adapted to generate an axial force which drives at least some ions axially through or along the first mass filter; and an analytical quadrupole mass filter or mass analyser arranged downstream of the first mass filter;

wherein the first mass filter is arranged and adapted to be operated so as to substantially restrict or reduce the ion current transmitted to the analytical quadrupole mass filter or mass analyser; and wherein the first mass filter and the analytical quadrupole mass filter or mass analyser are arranged and adapted to be operated in a mode of operation wherein:

(i) the first mass filter is arranged to mass filter ions with a first mass resolution $R_1$ and wherein at substantially the same time $T_1$ the analytical quadrupole mass filter or mass analyser is arranged to mass filter ions with a second mass resolution $R_2$, wherein $R_2>R_1$; and (ii) the first mass filter is arranged to transmit ions having a first mass to charge ratio or first mass to charge ratio range $M_1$ and at substantially the same time $T_1$ the analytical quadrupole mass filter or mass analyser is arranged to transmit having a second mass to charge ratio or second mass to charge ratio range $M_2$, wherein $M_1-M_2\leq x$ Da and wherein x is selected from the group consisting of: (i) 10; (ii) 5; (iii) 1; (iv) 0.5; (v) 0.1; (vi) 0.05; (vii) 0.01; (viii) 0.005; and (ix) 0.001.

U.S. Pat. No. 6,987,264 (Whitehouse) does not teach or suggest operating a mass filter upstream of an analytical quadrupole with a lower resolution than that of the analytical quadrupole.

U.S. Pat. No. 6,987,264 (Whitehouse) does not teach or suggest operating a mass filter upstream of an analytical quadrupole so that the centre of the upstream mass filter transmission window substantially coincides with the centre of the transmission window of the analytical quadrupole.

The present invention is particularly advantageous in that the upstream mass filter is arranged so as to significantly reduce contamination of the analytical quadrupole rod set.

According to another aspect of the present invention there is provided a method of mass spectrometry comprising:

providing a first mass filter comprising a plurality of electrodes and an analytical quadrupole mass filter or mass analyser arranged downstream of the first mass filter;

generating an axial force which drives at least some ions axially through or along the first mass filter;

operating the first mass filter so as to substantially restrict or reduce the ion current transmitted to the analytical quadrupole mass filter or mass analyser;

operating the first mass filter so as to mass filter ions with a first mass resolution $R_1$ and at substantially the same time $T_1$ operating the analytical quadrupole mass filter so as to mass filter ions with a second mass resolution $R_2$, wherein $R_2>R_1$; and operating the first mass filter so as to transmit ions having a first mass to charge ratio or first mass to charge ratio range $M_1$ and at substantially the same time $T_1$ operating the analytical quadrupole mass filter or mass analyser so as to transmit ions having a second mass to charge ratio or second mass to charge ratio range $M_2$, wherein $M_1-M_2\leq x$ Da and wherein x is selected from the group consisting of: (i) 10; (ii) 5; (iii) 1; (iv) 0.5; (v) 0.1; (vi) 0.05; (vii) 0.01; (viii) 0.005; and (ix) 0.001.

U.S. Pat. No. 6,987,264 (Whitehouse) does not teach or suggest operating a mass filter upstream of an analytical quadrupole with a lower resolution than that of the analytical quadrupole.

U.S. Pat. No. 6,987,264 (Whitehouse) does not teach or suggest operating a mass filter upstream of an analytical quadrupole so that the centre of the upstream mass filter transmission window substantially coincides with the centre of the transmission window of the analytical quadrupole.

The present invention is particularly advantageous in that the upstream mass filter is arranged so as to significantly reduce contamination of the analytical quadrupole rod set.

According to an aspect of the present invention there is provided a mass filter comprising:

a plurality of electrodes; and a first device arranged and adapted to generate an axial force which drives at least some ions axially through or along the mass filter.

According to a preferred embodiment the mass filter comprises an axially segmented quadrupole rod set ion guide. RF voltages are preferably applied to the electrodes forming the quadrupole rod set. The mass filter is preferably arranged to operate at a relatively high pressure in a mass or mass to charge ratio resolving mode wherein both resolving DC/RF voltages are applied to the electrodes and wherein additional or further DC voltages are also applied to the axial segments of the mass filter. The application of the additional or further DC voltages to the axial segments which together comprise a rod electrode results in the generation of an axial DC electric field which acts to urge ions along the length of the mass filter and through the mass filter. The axial DC electric field or DC potential gradient which is preferably maintained along the axial length of the mass filter preferably significantly reduces the transit time of ions through the mass filter.

The preferred embodiment enables a relatively high pressure mass filter to be provided by utilising an axial DC electric field to reduce the transit time of desired ions which are desired to be onwardly transmitted by the mass filter. As a result, the ion transmission efficiency of ions which are desired to be onwardly transmitted by the mass filter is substantially improved compared with conventional mass filters.

A particularly advantageous aspect of the preferred embodiment is that the mass filter is arranged to control or reduce the transit time of ions through the high pressure quadrupole or other ion guide so as to improve the resolving characteristics of the mass filter.

The present invention enables a high pressure mass filter to be provided which is particularly advantageous since conventional mass filters must be operated at relatively low pressures which requires relatively expensive vacuum pumps to be provided.

In contrast to conventional mass filters, the mass filter according to the preferred embodiment may, for example, be incorporated in a new generation of low cost and compact mass spectrometers which are being developed. The new generation of low cost and compact mass spectrometers are designed to be operated at relatively higher pressures than conventional high resolution mass spectrometers. As a result, the new generation of low cost and compact mass spectrometers do not require high performance vacuum pumps which enables the cost of the mass spectrometer to be significantly reduced. The mass filter according to the preferred embodiment is ideally suited to be incorporated into one of the new generation of mass spectrometers which are currently being developed. As will be apparent to those skilled in the art, a conventional quadrupole rod set mass filter would not be suitable for use in a relatively high pressure vacuum chamber such as may be used in one of the new generation of mass spectrometers.

The preferred embodiment therefore enables a mass filter to be provided which is capable of effectively mass filtering ions at relatively higher pressures than those which are currently associated with conventional quadrupole mass filters.

The mass filter according to the preferred embodiment also provides an effective way of protecting downstream ion-optical devices from excessive charge. For example, the mass filter according to the preferred embodiment may be arranged to filter out undesired ions in a relatively high pressure vacuum chamber arranged, for example, adjacent an atmospheric pressure interface of a mass spectrometer. The mass filter according to the preferred embodiment can therefore protect ion-optical devices such as an ion traps, high performance analytical mass filters or mass analysers or ion detectors which may be provided in a downstream vacuum chamber maintained at a much lower pressure from experiencing a high ion current which might otherwise cause the ion trap, high performance analytical mass filter or mass analyser or ion detector to suffer from saturation effects.

According to an embodiment the preferred mass filter may be provided downstream of an ion mobility spectrometer or separator and may be arranged to mass filter ions which emerge or elute from the ion mobility spectrometer or separator.

The plurality of electrodes preferably comprise a quadrupole rod set.

The quadrupole rod set preferably comprises an axially segmented quadrupole rod set. The axially segmented quadrupole rod set preferably comprise at least 4, 5, 6, 7, 8, 9, 10, 11, 12, 13, 14, 15, 16, 17, 18, 19 or 20 segments.

The plurality of electrodes preferably comprises a plurality of ring electrodes or other electrodes having at least one aperture through which ions are transmitted in use. According to an embodiment at least 4, 5, 6, 7, 8, 9, 10, 11, 12, 13, 14, 15, 16, 17, 18, 19 or 20 ring electrodes or other electrodes are preferably provided.

The first device is preferably arranged and adapted to maintain a DC axial electric field or a DC potential gradient across at least a section of the axial length of the mass filter in order to urge at least some ions along at least a portion of the axial length of the mass filter so as to generate the axial force.

The first device may be arranged and adapted to apply one or more transient DC voltages to the plurality of electrodes in order to urge at least some ions along at least a portion of the axial length of the mass filter so as to generate the axial force.

According to a less preferred embodiment the mass filter may further comprise one or more vane electrodes.

The first device may be arranged and adapted to apply either: (i) a DC voltage to the one or more vane electrodes in order to urge at least some ions along at least a portion of the axial length of the mass filter; and/or (ii) one or more transient DC voltages to the one or more vane electrodes in order to urge at least some ions along at least a portion of the axial length of the mass filter; and/or (iii) a multi-phase RF voltage to the one or more vane electrodes in order to urge at least some ions along at least a portion of the axial length of the mass filter.

The first device may be arranged and adapted to apply a multi-phase (e.g. 3-phase, 4-phase or higher phase) RF voltage to the plurality of electrodes in order to urge at least some ions along at least a portion of the axial length of the mass filter so as to generate the axial force.

The first device may comprise a gas flow device which is arranged and adapted to urge at least some ions along at least a portion of the axial length of the mass filter so as to generate the axial force.

The mass filter preferably comprises a second device arranged and adapted to apply one or more DC resolving voltages to at least some of the electrodes in order to cause undesired ions to assume unstable trajectories through the mass filter and/or to cause undesired ions to be radially ejected from the mass filter.

The second device is preferably arranged and adapted to cause undesired ions to be substantially attenuated.

The mass filter preferably further comprises a third device arranged and adapted to apply RF voltages to at least some of the electrodes in order to cause undesired ions to assume unstable trajectories through the mass filter and/or to cause undesired ions to be radially ejected from the mass filter.

The third device is preferably arranged and adapted to cause undesired ions to be substantially attenuated.

The mass filter is preferably arranged and adapted to be maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

The mass filter preferably has an axial length selected from the group consisting of: (i) <10 mm; (ii) 10-20 mm; (iii) 20-30 mm; (iv) 30-40 mm; (v) 40-50 mm; (vi) 50-60 mm; (vii) 60-70 mm; (viii) 70-80 mm; (ix) 80-90 mm; (x) 90-100 mm; (xi) 100-110 mm; (xii) 110-120 mm; (xiii) 120-130 mm; (xiv) 130-140 mm; (xv) 140-150 mm; (xvi) 150-160 mm; (xvii) 160-170 mm; (xviii) 170-180 mm; (xix) 180-190 mm; (xx) 190-200 mm; and (xxi) >200 mm.

The mass filter is preferably arranged to be maintained at a pressure P and has an axial length L, wherein the product P×L is selected from the group consisting of: (i) <0.001 mbar-mm; (ii) 0.001-0.01 mbar-mm; (iii) 0.01-0.1 mbar-mm; (iv) 0.1-1 mbar-mm; (v) 1-10 mbar-mm; (vi) 10-100 mbar-mm; (vii) 100-1000 mbar-mm; (viii) 1000-10,000 mbar-mm; (ix) 10,000-100,000 mbar-mm; and (x) >100,000 mbar-mm.

The mass filter is preferably switchable to operate in a mode of operation wherein ions are onwardly transmitted substantially independently of their mass to charge ratio.

The mass filter is preferably arranged to be switched to operate in a RF only mode of operation.

According to an embodiment when the mass filter is operated in a RF only mode of operation the mass filter acts as a broadband ion transmission ion guide.

According to another aspect of the present invention there is provided a mass spectrometer comprising a mass filter as described above.

The mass spectrometer preferably further comprises a further mass filter or mass analyser arranged downstream of the mass filter.

The further mass filter or mass analyser preferably comprises a quadrupole mass filter or mass analyser. The quadrupole mass filter or mass analyser preferably comprises a quadrupole rod set mass filter or mass analyser. The quadrupole rod set mass filter or mass analyser preferably comprises either a non-axially segmented quadrupole rod set mass filter or mass analyser or an axially segmented quadrupole rod set mass filter or mass analyser.

According to another embodiment the further mass filter or mass analyser comprises a Time of Flight mass analyser.

According to another embodiment the Time of Flight mass analyser comprises an axial acceleration Time of Flight mass analyser or an orthogonal acceleration Time of Flight mass analyser.

The mass spectrometer may further comprise an ion mobility spectrometer or separator arranged upstream of the mass filter, wherein the mass filter is arranged and adapted to mass filter ions which emerge from or elute from the ion mobility spectrometer or separator.

According to another aspect of the present invention there is provided a method of mass filtering ions comprising:

providing a mass filter; and generating an axial force which drives at least some ions axially through or along the mass filter.

According to another aspect of the present invention there is provided a method of mass spectrometry comprising a method of mass filtering as described above.

According to another aspect of the present invention there is provided a quadrupole rod set mass filter or mass analyser comprising a device arranged and adapted to axially accelerate ions through or along the mass filter or mass analyser.

According to another aspect of the present invention there is provided a method of mass filtering or mass analysing ions comprising:

providing a quadrupole rod set mass filter or mass analyser; and axially accelerating ions through or along the mass filter or mass analyser.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) a Surface Assisted Laser Desorption Ionisation ("SALDI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The mass spectrometer may comprise a chromatography detector.

The chromatography detector may comprise a destructive chromatography detector preferably selected from the group consisting of: (i) a Flame Ionization Detector ("FID"); (ii) an aerosol-based detector or Nano Quantity Analyte Detector ("NQAD"); (iii) a Flame Photometric Detector ("FPD"); (iv) an Atomic-Emission Detector ("AED"); (v) a Nitrogen Phosphorus Detector ("NPD"); and (vi) an Evaporative Light Scattering Detector ("ELSD").

Additionally or alternatively, the chromatography detector may comprise a non-destructive chromatography detector preferably selected from the group consisting of: (i) a fixed or variable wavelength UV detector; (ii) a Thermal Conductivity Detector ("TCD"); (iii) a fluorescence detector; (iv) an Electron Capture Detector ("ECD"); (v) a conductivity monitor; (vi) a Photoionization Detector ("PID"); (vii) a Refractive Index Detector ("RID"); (viii) a radio flow detector; and (ix) a chiral detector.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENT

A preferred embodiment of the present invention will now be described with reference to FIG. 1.

According to a preferred embodiment of the present invention a quadrupole rod set mass filter is provided. The quadrupole rod set mass filter preferably comprises an axially segmented quadrupole rod set wherein each of the four rods is axially segmented into a plurality of axial segments as shown in FIG. 1.

According to the preferred embodiment resolving DC and RF voltages are preferably applied to all of the rod electrodes. According to the preferred embodiment all the axial segments which together comprises a single rod electrode are supplied with the same resolving DC and RF voltages. The same resolving DC and RF voltages are applied to opposite axially segmented rod electrodes. Different resolving DC voltages and the opposite phase of the RF voltage are applied to adjacent axially segmented rod electrodes.

In addition to applying resolving DC and RF voltages to the rod electrodes, an axial DC voltage gradient is also preferably maintained along the length of each of the rod electrodes in order to control the transit time of ions through the quadrupole. According to the preferred embodiment different axial segments of a particular rod electrode are maintained at different DC voltages or potentials so that an axial DC voltage gradient is maintained along the length of the mass filter. Maintaining an axial DC voltage gradient along the length of the mass filter advantageously allows the mass filter to operate with minimal loss in transmission of ions of interest. The axially segmented nature of the rod electrodes allows DC voltages to be applied to the rod electrodes in order to urge ions along the length of the mass filter and also allows resolving DC/RF voltages to be applied to the electrodes in order to generate a substantially axially independent radial resolving DC electric field.

Although according to the preferred embodiment axial DC voltages are applied to all four axially segmented rod electrodes, less preferred embodiments are contemplated wherein DC voltages may be applied to just one, two or three of the axially segmented rod electrodes.

The segmented nature of the quadrupole rod set according to the preferred embodiment allows the application of the same phase of a RF voltage to all the axial segments of a particular rod electrode. According to the preferred embodiment opposed rod electrodes are maintained at the same RF phase and adjacent rod electrodes are preferably maintained at opposite phases of the RF voltage.

Figure 1:
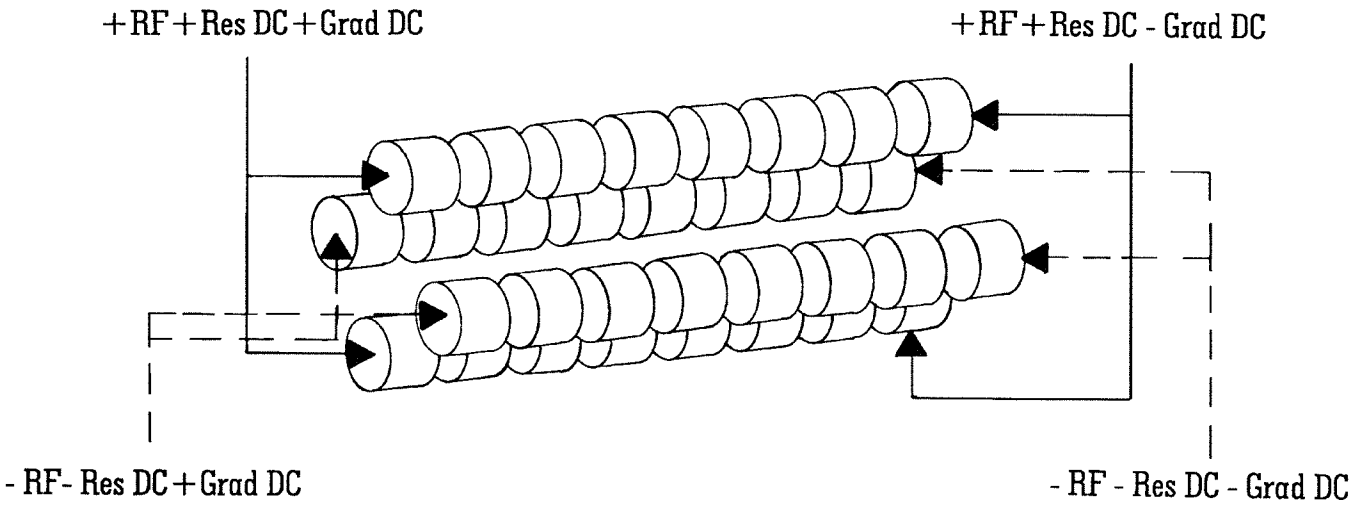
FIG. 1 shows a segmented quadrupole rod set mass filter according to a preferred embodiment and illustrates the DC/RF resolving voltages which are applied to the rod electrodes and also additional axial DC voltages which are applied to the rod electrodes in order to generate an axial DC electric field which cause ions to be accelerated axially through the mass filter.

As shown in FIG. 1 axially adjacent segments of the same rod electrode are preferably maintained at the same RF voltage and the same resolving DC voltage is preferably applied to all the axial segments comprising a rod electrode. According to a less preferred embodiment the same RF and DC resolving voltages may be applied to only some of the axial segments comprising a rod electrode.

Different axial field DC voltages are preferably applied to the segmented rod sections of a rod electrode so that an axial DC voltage gradient is preferably maintained along the length of the quadrupole in a mode of operation. For example, the rod segments of all four rod electrodes which are closest to an entrance end of the quadrupole mass filter may be maintained at the same voltage V1 and similarly all the rod segments of all four rod electrodes which are closest to an exit end of the quadrupole may be maintained at the same voltage V2. According to the preferred embodiment V1>V2. According to a particularly preferred embodiment V1 may be positive and V2 may be negative. According to an embodiment V1 may be in the range 0-10 V, 10-20 V, 20-30 V, 30-40 V, 40-50 V, 50-60 V, 60-70 V, 70-80 V, 80-90 V, 90-100 V or >100 V and/or V2 may be in the range <0V, 0 to −10 V, −10 to −20 V, −20 to −30 V, −30 to −40 V, −40 to −50 V, −50 to −60 V, −60 to −70 V, −70 to −80 V, −80 to −90 V, −90 to −100 V or <−100 V.

An ion population or group of ions transmitted to the mass filter and experiencing an axial electric field will preferably be driven through the mass filter or ion guide by the axial DC electric field or DC axial potential gradient thereby reducing the transit time of ions whilst at the same time the ions will undergo radial mass to charge ratio based mass filtering or mass to charge ratio instability filtering so that ions having undesired mass to charge ratios are radially excited or otherwise attenuated. Ions having undesired mass to charge ratios may impact upon the segmented rod electrodes and hence become lost to the system or otherwise be attenuated.

The mass filter according to the preferred embodiment exhibits a significant improvement in performance especially in relation to ion transmission efficiency compared with conventional quadrupole mass filters which do not utilise axial fields since the controlling (reduction) of the transit time of ions of interest is important for at least two reasons.

Firstly, the reduction in transit time improves performance and in particular the duty cycle of the mass filter for fast switching experiments.

Secondly, the reduction in transit time improves the performance of the device when acting as a mass filter since without the axial field the transit time of ions would otherwise be sufficiently long such that ions of interest will experience many cycles of the RF electric field which will result in some ions which are desired to be onwardly transmitted by the mass filter being inadvertently radially ejected from the mass filter or ion guide or otherwise lost to the rods.

Figure 2:
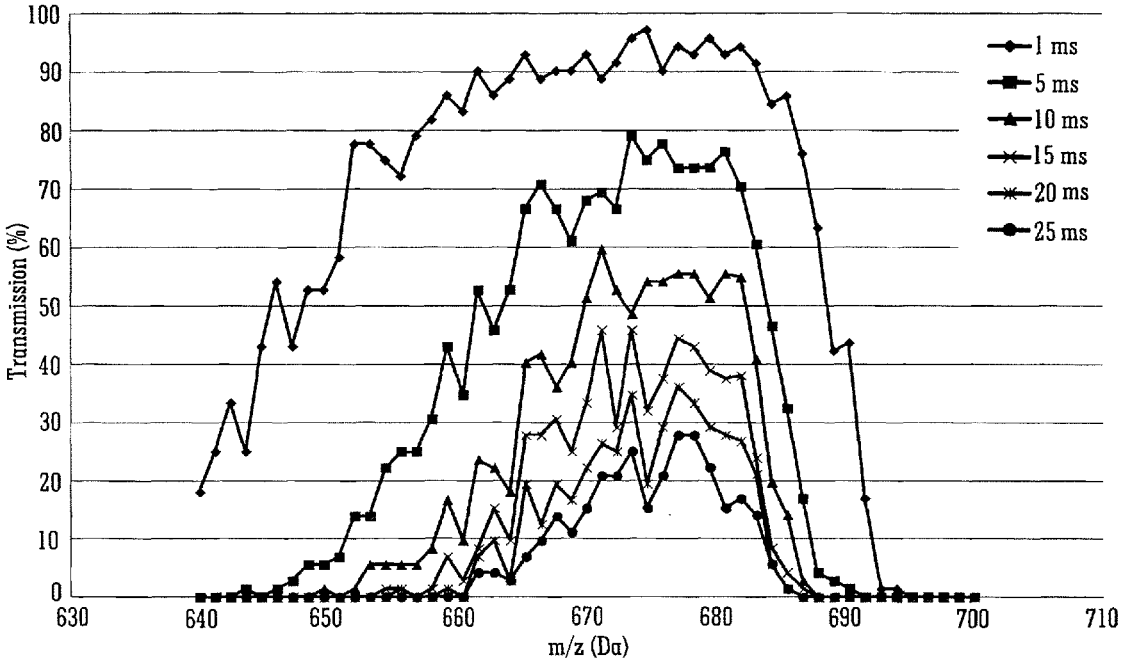
FIG. 2 shows the results of SIMION® modelling of the effect upon ion transmission efficiency of ions being retained within the mass filter for varying periods of time and in particular illustrates how the ion transmission efficiency is significantly improved if, as according to the preferred embodiment, ions are only retained within the mass filter for a relatively short period of time.

FIG. 2 shows the results of a SIMION® model which illustrates how ions may be inadvertently radially ejected from a quadrupole mass filter if the ions remain for too long within the mass filter such that the ions experience too many cycles of the RF electric field which will cause at least some of the ions to be radially ejected.

The SIMION® model was based upon a quadrupole mass filter having four rods having an inscribed radius r0 of 2.67 mm. An RF voltage was modelled as being applied to the rod electrodes at a frequency of 1 MHz. The background gas pressure was modelled as being at $7.5\times10^{-3}$ Torr argon.

The transmission efficiency of singly charged ions having a mass to charge ratio of 684 was simulated by scanning the resolving RF voltage amplitude from 328.3V to 359.0 V RF (0-peak) and the resolving DC voltage amplitude from 50.0 V to 54.7 V DC. The percentage of ions retained after 1 ms, 5 ms, 10 ms, 15 ms, 20 ms and 25 ms is shown in FIG. 2 as a function of mass to charge ratio. The results shown in FIG. 2 demonstrate how the ion transmission efficiency of a mass filter varies as a function of the time taken for ions to transit through the mass filter.

The results shown in FIG. 2 clearly show that exposing ions for a prolonged period of time (e.g. up to 25 ms) to the resolving RF and/or resolving DC voltages within the mass filter in combination with the presence of a background gas results in an increased likelihood of losses of the ions to the rod electrodes. Accordingly, if ions are retained within the mass filter for up to 25 ms then the ion transmission efficiency is relatively low (i.e. <30%). By comparison, if the ions are retained within the mass filter for a much short period of time (e.g. 1 ms) then the ion transmission efficiency can be very high e.g. >95%.

Figure 3A:
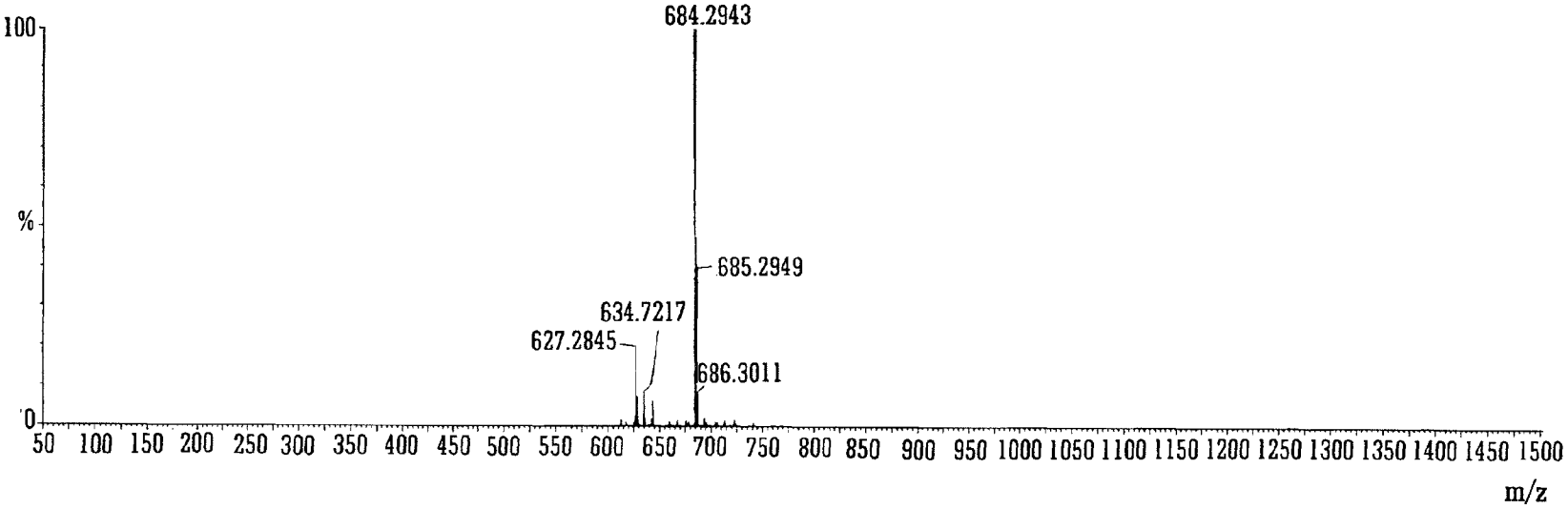
FIG. 3A shows a mass spectrum which was obtained according to an embodiment of the present invention wherein a resolving DC voltage of 36V in combination with a RF voltage was applied to the electrodes of a preferred mass filter.
Figure 3B:
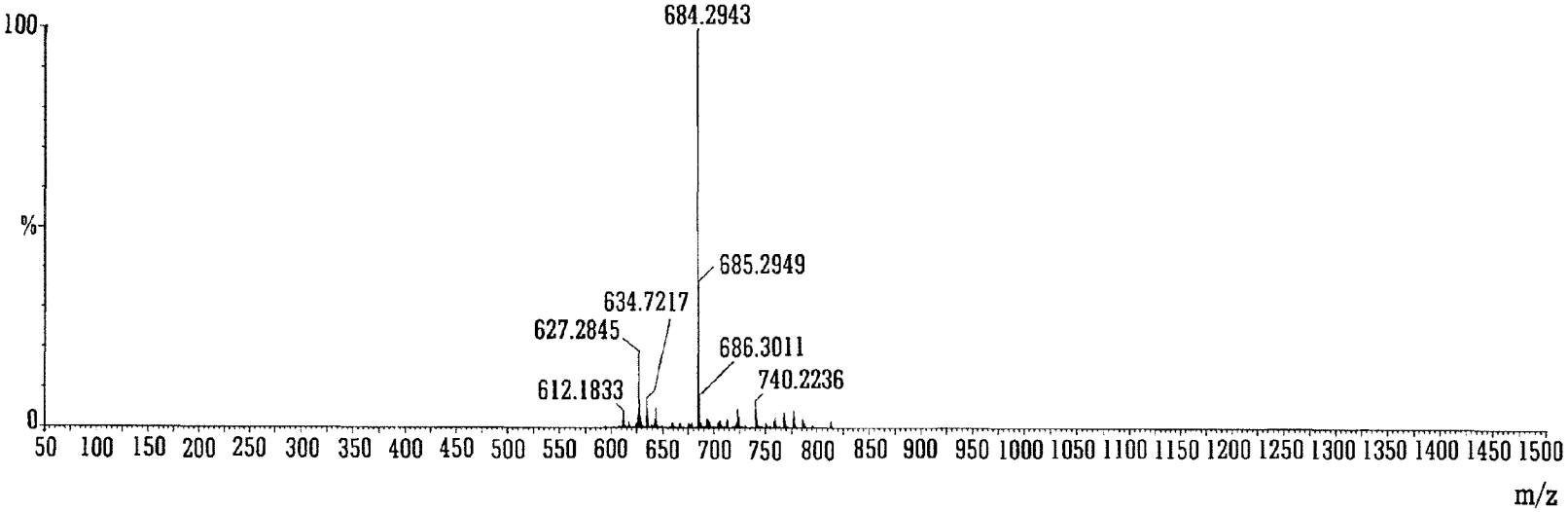
FIG. 3B shows a mass spectrum which was obtained according to an embodiment of the present invention wherein a resolving DC voltage of 34V in combination with a RF voltage was applied to the electrodes of a preferred mass filter and FIG. 3C shows a mass spectrum which was obtained when the preferred mass filter was operated in a RF only mode of operation (i.e. non-resolving mode) wherein the preferred mass filter effectively operated as a broadband transmission ion guide.
Figure 3C:
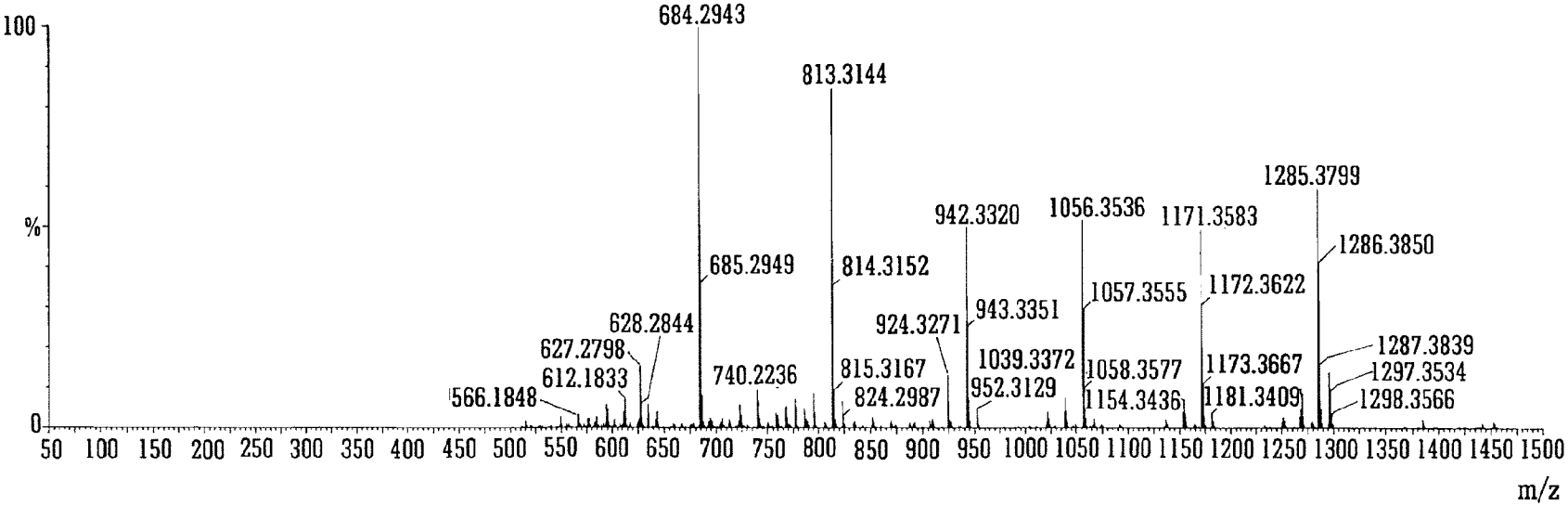

FIGS. 3A-3C show experimental results obtained using a mass filter according to a preferred embodiment. FIG. 3A shows a mass spectrum obtained when the mass filter was operated in a resolving mode of operation wherein 36 V of resolving DC was applied to the rod electrodes. FIG. 3B shows a mass spectrum obtained when the mass filter was operated in a resolving mode of operation wherein 34 V of resolving DC was applied to the rod electrodes. FIG. 3C shows a mass spectrum obtained when the mass filter was operated in a non-resolving mode of operation i.e. without a resolving DC voltage being applied to the rod electrodes. As will be understood by those skilled in art, when the mass filter is operated in a non-resolving mode or a RF only mode of operation then the mass filter operates or performs like a broadband transmission ion guide i.e. ions are not actively mass filtered by the ion guide and substantially all ions received at the entrance to the mass filter/ion guide are onwardly transmitted by the mass filter/ion guide.

Figure 4:
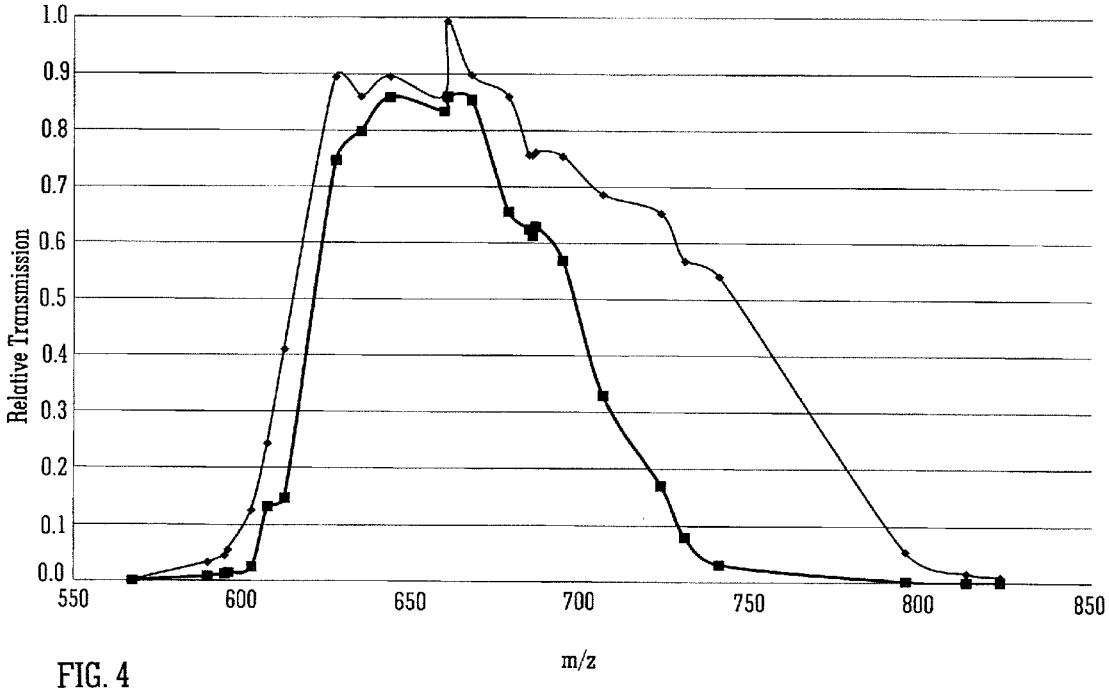
FIG. 4 shows relative transmission curves based upon the mass spectra shown in FIGS. 3A-3C and in particular shows: (i) the relative transmission of ions when 36V of resolving DC in combination with a RF voltage was applied to the rods relative to when the mass filter was operated in a RF only mode; and (ii) the relative transmission of ions when 34V of resolving DC in combination with a RF voltage was applied to the rods relative to when the mass filter was operated in a RF only mode.

FIG. 4 shows relative transmission curves for the two resolving DC voltages detailed above in relation to FIGS. 3A and 3B and shows the relative transmission of ions as a function of mass to charge ratio for ions when transmitted through the mass filter operating in a mass resolving mode of operation compared to ions being transmitted through the mass filter when operating in a non-resolving mode of operation (wherein the ion transmission efficiency should be 100%).

For the data shown in FIGS. 3A-3C and FIG. 4 the axial DC electric field was set to 1 V across the full 120 mm length of the device. The inscribed radius of the rods R0 was arranged to be 5.3 mm and the RF voltage applied to the rod electrodes was 1 MHz at 600 V peak to peak. The pressure within the mass filter was arranged to be approximately $1\times10^{-2}$ mbar of argon.

According to an embodiment the preferred mass filter may be used as a low performance high pressure mass filter or mass analyser. In particular, the preferred device may be arranged upstream of a higher performance analytical mass filter or mass analyser such as a quadrupole rod set mass filter or mass analyser or a Time of Flight mass spectrometer. The preferred mass filter may advantageously be operated or otherwise arranged to reduce the ion current reaching the high performance analytical mass filter or mass analyser thus improving the robustness and lifetime of the high performance analytical mass filter or mass analyser by reducing charging issues.

The preferred device may be used downstream of an ion mobility spectrometer or separator and may be arranged to be operated in a linked scanning mode of operation. For example, a mass to charge ratio transmission window of the mass filter according to the preferred embodiment may be scanned in synchronism with the ion mobility spectrometer or separator so that ions which elute from an upstream ion mobility spectrometer or separator and which are received by the mass filter are mass filtered in a manner such that only ions having a particular charge state (e.g. doubly, triply or higher charged) are onwardly transmitted whereas other ions having different charge states (e.g.

The preferred mass filter may be used upstream of a charge limited device such as an ion trap or an accumulation device to allow higher duty cycle. The accumulation device may be arranged upstream of an ion mobility spectrometer or separator.

According to other less preferred embodiments alternative methods of driving the ions axially through the mass filter may be utilised including applying DC travelling waves or transient DC voltages or potentials to the electrodes comprising the mass filter. Other embodiments are contemplated wherein one or more vane electrodes may be provided and DC and/or RF voltages may be applied to the one or more vane electrodes in order to accelerate ions axially. According to other embodiments a multi-phase RF voltage may be applied to the electrodes in order to drive the ions axially. According to another embodiment one or more gas flow drives or mechanisms may also be used to drive ions at least along a portion or section of the mass filter.

Multiple preferred devices may be combined to provide multiple stages of mass filtering or mass analysis together with optional fragmentation of ions at relatively high pressures.

The segmented nature of the preferred mass filter allows multiple configurations to be adopted. For example, according to an embodiment a section or region of the mass filter may be arranged to form an ion trapping region wherein ions may be confined axially within the ion trapping section or region of the mass filter by application or one or more DC and/RF voltages to e.g. entrance and/or exit electrode(s).

According to an embodiment of the present invention one or more pre-filters and/or one or more post-filters may be provided. The one or more pre-filters and/or one or more post-filters may optionally be incorporated within or otherwise be attached to the preferred device. According to an embodiment the pre-filter(s) and/or post-filter(s) may comprise a short quadrupole rod set or "stubbie" as is well known in the art.

Ions may be pulsed into the preferred mass filter. Embodiments are also contemplated wherein ions may also be separated according to their mass to charge ratio and/or ion mobility optionally in combination with being mass filtered as the ions are being axially accelerated through the device.

Other radial ejection mechanisms such as resonance ejection by applying excitation voltages to the electrodes forming the mass filter may also be used. According to an embodiment a broadband excitation voltage having one or more frequency notches may be applied to the electrodes forming the mass filter.

The preferred device may be preceded by or followed by a wide range of known ionisation sources, fragmentation devices and analysers.

Multiple preferred devices may be combined either in series or in parallel.

RF devices other than quadrupoles may be used and may allow some degree of mass filtering.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising:

a first mass filter comprising a plurality of electrodes and a first device arranged and adapted to generate an axial force which drives at least some ions axially through or along said first mass filter, said first device being arranged and adapted to maintain a DC axial electric field or a DC potential gradient across at least a section of the axial length of said first mass filter, or apply one or more transient DC voltages to said plurality of electrodes in order to urge at least some ions along at least a portion of the axial length of said first mass filter so as to generate said axial force; and a quadrupole mass filter or quadrupole mass analyser arranged downstream of said first mass filter, wherein said first mass filter and said quadrupole mass filter or quadrupole mass analyser are arranged and adapted to be operated in a mode of operation wherein:

(i) said first mass filter is arranged to mass filter ions with a first mass resolution $R_1$ and wherein at substantially the same time $T_1$ said quadrupole mass filter or quadrupole mass analyser is arranged to mass filter ions with a second mass resolution $R_2$, wherein $R_2>R_1$; and (ii) said first mass filter is arranged to transmit ions having a first mass to charge ratio or first mass to charge ratio range $M_1$ and wherein at substantially the same time $T_1$ said quadrupole mass filter or quadrupole mass analyser is arranged to transmit ions having a second mass to charge ratio or second mass to charge ratio range $M_2$, wherein $M_1-M_2 \leq x$ Da and wherein x is selected from the group consisting of: (i) 10; (ii) (iii) 1; (iv) 0.5; (v) 0.1; (vi) 0.05; (vii) 0.01; (viii) 0.005; and (ix) 0.001.

2. A mass spectrometer as claimed in claim 1, wherein said quadrupole mass filter or quadrupole mass analyser comprises an analytical mass filter or mass analyser.

3. A mass spectrometer as claimed in claim 1, wherein said first mass filter is arranged and adapted to be operated in a substantially synchronised manner with said quadrupole mass filter or quadrupole mass analyser.

4. A mass spectrometer as claimed in claim 1, wherein said first mass filter is arranged and adapted to be operated so as to substantially restrict or reduce the ion current transmitted to said quadrupole mass filter or quadrupole mass analyser.

5. A mass spectrometer as claimed in claim 1, wherein said first mass resolution $R_1=(m/z)/W_{1/2}$ wherein m/z is the mass to charge ratio of an ion peak and $W_{1/2}$ is the ion peak width at half height and wherein said second mass resolution $R_2=(m/z)/W_{1/2}$ wherein m/z is the mass to charge ratio of an ion peak and $W_{1/2}$ is the ion peak width at half height.

6. A mass spectrometer as claimed in claim 1, wherein said first mass filter and said quadrupole mass filter or quadrupole mass analyser are arranged and adapted to be operated in a mode of operation wherein said first mass filter is arranged to transmit ions having a first mass to charge ratio $M_1$ and wherein at substantially the same time $T_1$ said quadrupole mass filter or quadrupole mass analyser is arranged to transmit ions having a second mass to charge ratio $M_2$, wherein $M_1=M_2$.

7. A mass spectrometer as claimed in claim 6, wherein at said time $T_1$ said first mass filter is arranged to attenuate ions having a mass to charge ratio less than and/or greater than $M_1$, or, wherein at said time $T_1$ said quadrupole mass filter or quadrupole mass analyser is arranged and adapted to attenuate ions having a mass to charge ratio less than and/or greater than $M_2$.

8. A mass spectrometer as claimed in claim 1, wherein at said time $T_1$ said first mass filter is arranged to attenuate ions having a mass to charge ratio less than and/or greater than $M_1$, or, wherein at said time $T_1$ said quadrupole mass filter or quadrupole mass analyser is arranged and adapted to attenuate ions having a mass to charge ratio less than and/or greater than $M_2$.

9. A mass spectrometer as claimed in claim 1, wherein:

said first mass filter and/or said quadrupole mass filter or quadrupole mass analyser are arranged and adapted to be maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar; or said first mass filter and/or said quadrupole mass filter or quadrupole mass analyser have an axial length selected from the group consisting of: (i) <10 mm; (ii) 10-20 mm; (iii) 20-30 mm; (iv) 30-40 mm; (v) 40-50 mm; (vi) 50-60 mm; (vii) 60-70 mm; (viii) 70-80 mm; (ix) 80-90 mm; (x) 90-100 mm; (xi) 100-110 mm; (xii) 110-120 mm; (xiii) 120-130 mm; (xiv) 130-140 mm; (xv) 140-150 mm; (xvi) 150-160 mm; (xvii) 160-170 mm; (xviii) 170-180 mm; (xix) 180-190 mm; (xx) 190-200 mm; and (xxi) >200 mm; or said first mass filter and/or said quadrupole mass filter or quadrupole mass analyser are arranged to be maintained at a pressure P and has an axial length L, wherein the product PxL is selected from the group consisting of: (i) <0.001 mbar-mm; (ii) 0.001-0.01 mbar-mm; (iii) 0.01-0.1 mbar-mm; (iv) 0.1-1 mbar-mm; (v) 1-10 mbar-mm; (vi) 10-100 mbar-mm; (vii) 100-1000 mbar-mm; (viii) 1000-10,000 mbar-mm; (ix) 10,000-100,000 mbar-mm; and (x) >100,000 mbar-mm.

10. A mass spectrometer as claimed in claim 1, further comprising a second device arranged and adapted to apply one or more DC resolving voltages to at least some of said electrodes in order to cause undesired ions to assume unstable trajectories through said first mass filter and/or to cause undesired ions to be radially ejected from said first mass filter, wherein said second device is arranged and adapted to cause undesired ions to be substantially attenuated.

11. A mass spectrometer as claimed in claim 1, further comprising a third device arranged and adapted to apply RF voltages to at least some of said electrodes in order to cause undesired ions to assume unstable trajectories through said first mass filter and/or to cause undesired ions to be radially ejected from said first mass filter, wherein said third device is arranged and adapted to cause undesired ions to be substantially attenuated.

12. A mass spectrometer as claimed in claim 1, wherein said plurality of electrodes comprises a quadrupole rod set, wherein said quadrupole rod set comprises an axially segmented quadrupole rod set.

13. A mass spectrometer as claimed in claim 1, wherein said plurality of electrodes comprises a plurality of ring electrodes or other electrodes having at least one aperture through which ions are transmitted in use, wherein said plurality of ring electrodes are radially segmented.

14. A mass spectrometer as claimed in claim 1, wherein said first mass filter further comprises one or more vane electrodes, wherein said first device is arranged and adapted to apply either: (i) a DC voltage to said one or more vane electrodes in order to urge at least some ions along at least a portion of the axial length of said first mass filter; and/or (ii) one or more transient DC voltages to said one or more vane electrodes in order to urge at least some ions along at least a portion of the axial length of said first mass filter; and/or (iii) a multi-phase RF voltage to said one or more vane electrodes in order to urge at least some ions along at least a portion of the axial length of said first mass filter.

15. A mass spectrometer as claimed in claim 1, wherein said first device is arranged and adapted to apply a multi-phase RF voltage to said plurality of electrodes in order to urge at least some ions along at least a portion of the axial length of said first mass filter so as to generate said axial force, or, wherein said first device comprises a gas flow device which is arranged and adapted to urge at least some ions along at least a portion of the axial length of said first mass filter so as to generate said axial force.

16. A mass spectrometer as claimed in claim 1, wherein said first mass filter is switchable to operate in a mode of operation wherein ions are onwardly transmitted substantially independently of their mass to charge ratio, and wherein said first mass filter is arranged to be switched to operate in a RF only mode of operation, wherein when said first mass filter is operated in said RF only mode of operation said first mass filter acts as a broadband ion transmission ion guide.

17. A mass spectrometer as claimed in claim 1, further comprising an ion mobility spectrometer or separator arranged upstream of said first mass filter, wherein said first mass filter is arranged and adapted to mass filter ions which emerge from or elute from said ion mobility spectrometer or separator.

18. A method of mass spectrometry comprising:

providing a first mass filter comprising a plurality of electrodes and a quadrupole mass filter or quadrupole mass analyser arranged downstream of said first mass filter; and generating an axial force which drives at least some ions axially through or along said first mass filter by maintaining a DC axial electric field or a DC potential gradient across at least a section of the axial length of said first mass filter or by applying one or more transient DC voltages to said plurality of electrodes in order to urge at least some ions along at least a portion of the axial length of said first mass filter, operating said first mass filter so as to mass filter ions with a first mass resolution $R_1$ and at substantially the same time $T_1$ operating said quadrupole mass filter or quadrupole mass analyser so as to mass filter ions with a second mass resolution $R_2$, wherein $R_2>R_1$; and operating said first mass filter so as to transmit ions having a first mass to charge ratio or first mass to charge ratio range $M_1$ and at substantially the same time $T_1$ operating said quadrupole mass filter or quadrupole mass analyser so as to transmit ions having a second mass to charge ratio or second mass to charge ratio range $M_2$, wherein $M_1-M_2 \leq x$ Da and wherein x is selected from the group consisting of: (i) 10; (ii) 5; (iii) 1; (iv) 0.5; (v) 0.1; (vi) 0.05; (vii) 0.01; (viii) 0.005; and (ix) 0.001.

19. A mass spectrometer comprising:

a first mass filter comprising a plurality of electrodes and a first device arranged and adapted to generate an axial force which drives at least some ions axially through or along said first mass filter; and an analytical quadrupole mass filter or analytical quadrupole mass analyser arranged downstream of said first mass filter;

wherein said first mass filter is arranged and adapted to be operated so as to substantially restrict or reduce the ion current transmitted to said analytical quadrupole mass filter or analytical quadrupole mass analyser; and wherein said first mass filter and said analytical quadrupole mass filter or analytical quadrupole mass analyser are arranged and adapted to be operated in a mode of operation wherein:

(i) said first mass filter is arranged to mass filter ions with a first mass resolution $R_1$ and wherein at substantially the same time $T_1$ said analytical quadrupole mass filter or analytical quadrupole mass analyser is arranged to mass filter ions with a second mass resolution $R_2$, wherein $R_2>R_1$; and (ii) said first mass filter is arranged to transmit ions having a first mass to charge ratio or first mass to charge ratio range $M_1$ and at substantially the same time $T_1$ said analytical quadrupole mass filter or analytical quadrupole mass analyser is arranged to transmit having a second mass to charge ratio or second mass to charge ratio range $M_2$, wherein $M_1-M_2 \leq x$ Da and wherein x is selected from the group consisting of: (i) 10; (ii) 5; (iii) 1; (iv) 0.5; (v) 0.1; (vi) 0.05; (vii) 0.01; (viii) 0.005; and (ix) 0.001.

* * * * *